US012188225B2

(12) United States Patent
Escribano Baeyens

(10) Patent No.: US 12,188,225 B2
(45) Date of Patent: Jan. 7, 2025

(54) CONSTRUCTIVE ASSEMBLY

(71) Applicant: CERÁMICA MALPESA, S.A., Jaén (ES)

(72) Inventor: Antonio José Escribano Baeyens, Jaén (ES)

(73) Assignee: CERÁMICA MALPESA, S.A., Jaén (ES)

( * ) Notice: Subject to any disclaimer, the term of this patent is extended or adjusted under 35 U.S.C. 154(b) by 435 days.

(21) Appl. No.: 17/774,154

(22) PCT Filed: Nov. 5, 2020

(86) PCT No.: PCT/EP2020/081050
§ 371 (c)(1),
(2) Date: May 4, 2022

(87) PCT Pub. No.: WO2021/089669
PCT Pub. Date: May 14, 2021

(65) Prior Publication Data

US 2022/0403649 A1 Dec. 22, 2022

(30) Foreign Application Priority Data

Nov. 5, 2019 (EP) ..... 19382966

(51) Int. Cl.
*E04B 2/02* (2006.01)

(52) U.S. Cl.
CPC ..... *E04B 2/02* (2013.01); *E04B 2002/0202* (2013.01)

(58) Field of Classification Search
CPC .. E04B 2/02; E04B 2002/0202; E01F 8/0011; E01F 8/0017
See application file for complete search history.

(56) References Cited

U.S. PATENT DOCUMENTS

| | | | | |
|---|---|---|---|---|
| 5,368,416 | A | 11/1994 | Cataldo | |
| 5,588,786 | A | 12/1996 | House et al. | |
| 9,714,510 | B2 * | 7/2017 | Castonguay | E02D 29/02 |
| 10,352,042 | B2 * | 7/2019 | Malpesa Guerrero | E04B 1/12 |
| 2003/0188497 | A1 * | 10/2003 | Price | E04F 13/0803 52/169.12 |
| 2014/0298747 | A1 * | 10/2014 | Castonguay | E04B 2/44 52/562 |
| 2017/0356184 | A1 * | 12/2017 | Guerrero | E04B 2/02 |

FOREIGN PATENT DOCUMENTS

| | | | |
|---|---|---|---|
| JP | 2003172048 | A * | 6/2003 |
| WO | 9012170 | A1 | 10/1990 |
| WO | 20050081763 | A2 | 9/2005 |

* cited by examiner

*Primary Examiner* — Rodney Mintz
(74) *Attorney, Agent, or Firm* — S.J. Intellectual Property LTD.

(57) ABSTRACT

The present invention relates to a constructive assembly which allows constructing walls that are not necessarily vertical, allows including ventilated regions, and does not require the use of mortar or adhesives. The resulting construction has a high finish quality and this quality does not depend on the skill of the operator in charge of constructing same. This invention is characterized by the combination of rigid profiles distributed in parallel and blocks configured to be readily inserted between the profiles and attached thereto without requiring additional fixing elements.

18 Claims, 7 Drawing Sheets

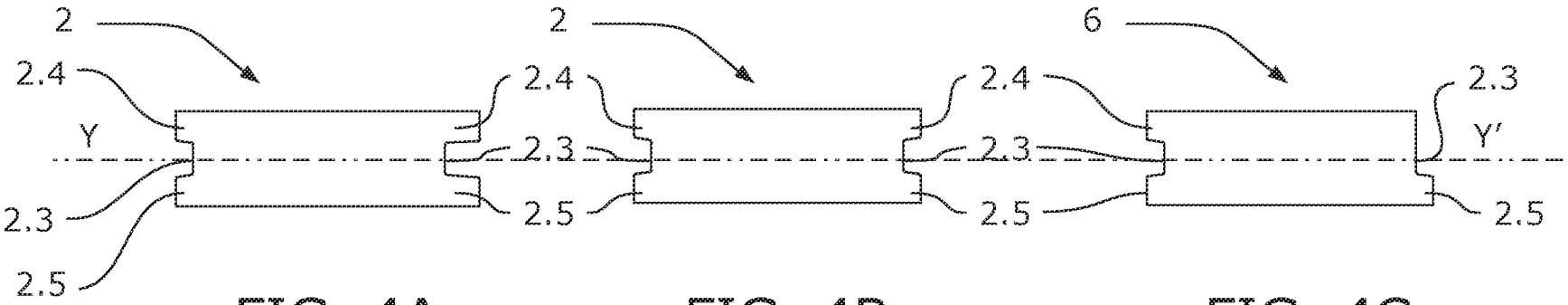
FIG. 4A
FIG. 4B
FIG. 4C
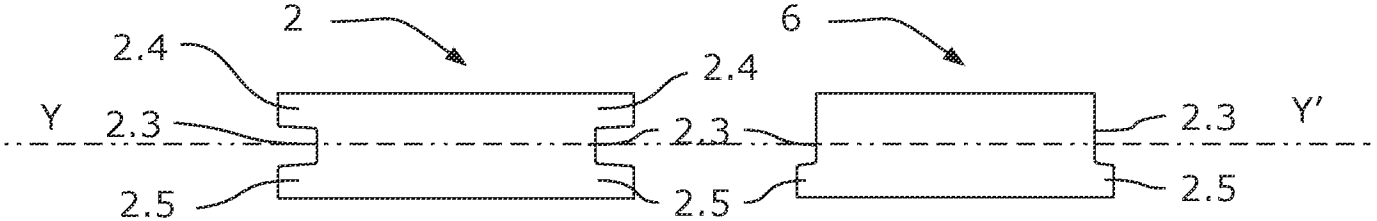
FIG. 4D
FIG. 4E
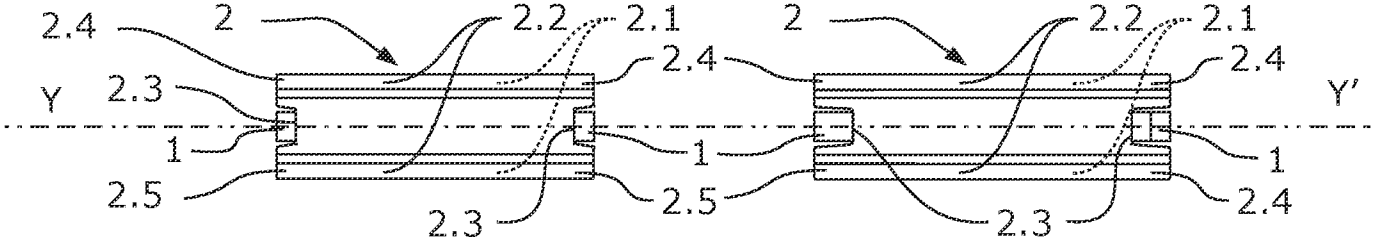
FIG. 5A
FIG. 5B

CONSTRUCTIVE ASSEMBLY

OBJECT OF THE INVENTION

The present invention relates to a constructive assembly which allows constructing walls that are not necessarily vertical, allows including ventilated regions, and does not require the use of mortar or adhesives. The resulting construction has a high finish quality and this quality does not depend on the skill of the operator in charge of constructing same.

This invention is characterized by the combination of rigid profiles distributed in parallel and blocks configured to be readily inserted between the profiles and attached thereto without requiring additional fixing elements.

The present invention is also directed to a method for mounting a constructive assembly.

BACKGROUND OF THE INVENTION

One of the most intensively developed fields of the art in construction is the use of solutions which avoid the use of mortar. The tremendous growth and subsequent decline of the construction sector gave rise to a significant lack of skilled labor for constructing conventional brick walls that are put together using mortar.

In brick walls of this type which are put together using mortar, the quality of the final finish of the wall greatly depends on the skill of the operator in charge of constructing same. It is a job that must be done by hand in which the size of the head joint must be uniform along the entire height, and there are no machines responsible for assuring this uniformity.

The present invention solves these problems with the combination of several components giving rise to a very strong construction which allows constructing both walls that are not necessarily vertical and walls that readily allow various angulations or even the formation of ventilated walls; all this without the end quality of the wall thus constructed depending on the skill of the operator in charge of the construction.

DESCRIPTION OF THE INVENTION

According to a first inventive aspect, the present invention relates to a constructive assembly which allows constructing walls that do not necessarily result in a vertical surface.

The constructive assembly comprises:

- a plurality of guide profiles configured in the form of a rigid rod extending along a first longitudinal direction X-X';
- a plurality of blocks, wherein:
  - the blocks have an elongated configuration extending along a second longitudinal direction Y-Y',
  - the blocks comprise a first supporting base and a second supporting base parallel to the first supporting base, wherein both supporting bases are in turn parallel to the second longitudinal direction Y-Y',
  - the blocks comprise at each end according to the second longitudinal direction Y-Y' a cavity located between two fixing flanges, wherein the cavity is intended for receiving a guide profile such that said guide profile limits the movement thereof according to a direction transverse to the second longitudinal direction and parallel to any of the supporting bases;

wherein

- the plurality of guide profiles are fixed and distributed such that they are parallel to and spaced from one another;
- the plurality of blocks are distributed such that they are stacked between two of the guide profiles, wherein for each block of the plurality of blocks a guide profile is housed at least partially in the cavity of one end of the block and the other guide profile is housed at least partially in the cavity of the opposite end of the block, and
- each block is secured to the two guide profiles maintaining a sliding attachment according to the longitudinal direction X-X' of the guide profile.

The essential elements of the invention are a plurality of guide profiles and a plurality of blocks particularly configured for being located such that they are stacked by means of the consecutive support of their bases parallel to one another and attached by means of the guide profiles.

The simplest configuration of the invention according to one embodiment is a vertical wall wherein the guide profiles are distributed in parallel, positioned vertically, and spaced from one another, forming a plane. The guide profiles are rigid and intended for receiving the plurality of blocks, wherein each of the blocks is fixed between two of the consecutive profiles.

Each of the blocks has a cavity located between two flanges, one cavity at one end and the other cavity at the other opposite end. One cavity is configured for receiving a guide profile and the other cavity, located at the opposite end, is intended for receiving the other guide profile.

Although the cavities located between flanges prevent the placement and removal of the block, during construction the block can indeed be placed if it is positioned in an oblique manner given that, in projection with respect to its final position, the block shows a distance that is smaller than the distance between the two guide profiles that will fix same. Therefore, adding a block to the construction entails placing the block in an oblique position and then turning it to its final position, causing both cavities to receive their respective profiles.

Placement in an oblique position is possible as a result of the condition of each block being secured to the two guide profiles, maintaining a sliding attachment according to the longitudinal direction X-X' of the guide profile.

This operation of inserting a block is repeated from a first base on which the guide profiles are positioned and the wall is gradually erected by stacking blocks. Upon reaching the upper part, if the wall is not limited, the weight itself may be sufficient to keep the resulting construction stable.

According to one embodiment, the wall is stabilized by also fixing the upper ends of the guide profiles, those located opposite the ends of said profiles which are fixed at the first base, i.e., the lower base.

According to another embodiment, when the upper base is physically limited by a surface, for example, by an cantilever or a roof, this surface preferably serves as a fixing surface for the upper ends of the guide profiles.

In this last embodiment, insertion of the upper blocks may be prevented given that the surface acting as an upper base limits the placement of the block in an oblique position. For these cases, according to an embodiment of the invention, finishing blocks with a specific configuration are provided, wherein one of the flanges between which there is located one of the cavities intended for receiving a guide profile is absent. Therefore, this finishing block is first placed at the end having the cavity located between two flanges until the cavity houses the corresponding guide profile and then the other end is placed given that it has no flange which prevents same. This movement of insertion is parallel to the bases thereof without having to perform any oblique placement.

According to other less simple embodiments of the distribution of the guide profiles, although they are distributed parallel to one another according to a plane transverse to the guide profiles, the distribution configures a polygon instead of a line.

When these guide profiles are located on a base, this base shows a polygonal configuration. According to this embodiment, a stack of blocks is formed on each side of the polygon.

According to one embodiment, the flanges of the blocks have a size such that they do not reach the flange of the block of the adjacent stack, so the first supporting base of a block rests on the second supporting base of the block immediately therebelow, and its second supporting base in turn serves as a support for the first supporting base of the block arranged thereabove.

According to another embodiment, the flanges of the blocks have a size such that they reach the flange of the block of the adjacent stack, so when situating this block in the stack, its lower base does not rest on the block located immediately therebelow but rather on the flanges of the blocks of the adjacent stacks on either side.

The result is a stack leaving a gap below the block which complies with this condition of support on the flanges of the blocks of adjacent stacks, giving rise to a wall with ventilation gaps generating a latticework.

Both types of block can be combined forming walls having areas without ventilation gaps and other areas having ventilation gaps.

Once the blocks are stacked, if the first blocks are supported on a first base attached to the guide profiles and finished with a second base attached to the opposite ends of the guide profiles preventing the removal of the last blocks, this assembly can be transferred once constructed.

According to the described examples, the action of gravity secures the stack of blocks and these blocks will stay in their final position without requiring mortar. Nevertheless, according to a specific example of the invention, an embodiment in which the guide profiles are located horizontally according to the action of gravity instead of vertically as described up until now is of great interest.

What used to be a first horizontal base is now a vertical base such that the installation of the blocks is as described but the oblique placement position of each block is with respect to the block already located in the final position. Once located in its final position, the weight of the block does not rest on its first base but rather on the inner surfaces of the cavity demarcated between flanges which support and transmit loads due to the weight on one or two guide profiles between which the block is located.

According to this embodiment, the stack grows horizontally until reaching the opposite end which can be closed by means of a second base of the construction.

According to this embodiment, the fractionated line or polygonal distribution of the parallel guide profiles gives rise to a wall with non-vertical oblique planes.

Other examples of interest are described below using the drawings.

A second inventive aspect of the present invention comprises a method for mounting a constructive assembly according the first inventive aspect, the method comprising the following steps:

a) positioning at least two guide profiles, distributed such that they are parallel according to their longitudinal direction (X-X'), and spaced from one another, b) placing a block in an oblique position in respect to a direction perpendicular to the longitudinal direction (X-X') and being said block between the two guide profiles, c) turning the block such that the two cavities of the block receive a corresponding guide profile of the at least two guide profiles, d) repeating steps b) and c) with additional blocks placing additional blocks in a stacked manner.

According to the present method, a wall can be mounted by means of at least two guide profiles, which are placed in a first step of the method, step a), with a predetermined distance one from the other, each of the guide profiles following a first longitudinal direction (X-X'). In a particular embodiment, the at least two guide profiles, once positioned, form a plane.

In a particular embodiment, said longitudinal direction is the vertical direction according to the gravity direction.

Therefore, the at least two guide profiles thus provide at least two fixed posts wherein blocks can be sequentially mounted, such that a wall is obtained once the following steps of the method are performed.

Particularly, the second step of the present method, step b), arranges a block obliquely between the at least two guide profiles in respect to a direction perpendicular to the longitudinal direction (X-X'), such that it can be inserted between said at least two guide profiles in its final position. This oblique orientation used when placing a block between two guide profiles is in respect to the orientation of said block when it is in its final position in an operative manner. The oblique orientation provides a shorter distance between the two ends of the block when measured according to a projection over the final position allowing said block to enter between said two guide profiles.

In order to achieve the mentioned said final position, the block is turned around in step c) of the present method.

This way, the cavities present in the block are positioned such that each of the guide profiles is housed in a corresponding cavity of the block, said block being correctly positioned according to the plane defined by the two guide profiles between two fixing flanges.

Thus, a wall can be obtained by repeating the positioning of several blocks, according to the aforementioned steps b) and c), such that additional blocks are stacked one on top of the other until the at least two guide profiles are completely covered by said blocks. Particularly, the term "stacked" referring to the blocks corresponds to the fact that each of the mounted blocks are totally or partially supported on a lower block, such that, when mounted, there can be empty gaps in-between the mentioned blocks, or the mounted blocks form a continuous surface.

In a particular embodiment, the wall is mounted from the lower base, the stack of blocks following the vertical direction of the guide profiles.

In a particular embodiment, step c) further comprises fixing each block to the two guide profiles, particularly fixing each block two flanges.

In a particular embodiment, steps b) to d) are repeated to obtain a wall that covers a predetermined distance, both in the longitudinal direction (X-X') and in the direction perpendicular to said longitudinal direction (X-X').

In a particular embodiment, the blocks located on either side of one and the same guide profile have overlapping fixing flanges, giving rise to empty gaps, i.e. ventilated gaps, throughout the constructive assembly.

DESCRIPTION OF THE DRAWINGS

These and other features and advantages of the invention will be more clearly understood based on the following detailed description of a preferred embodiment given only by way of illustrative and non-limiting example in reference to the attached drawings.

FIGS. 4A-4E show embodiments of the blocks for the construction of the main area of a wall and finishing blocks or parts.

FIGS. 5A and 5B show the plan view of two embodiments of blocks with a specific support configuration according to two side bands together with the guide profiles with which attachment is established.

DETAILED DISCLOSURE OF THE INVENTION

According to the first inventive aspect, the present invention relates to a constructive assembly.

Figure 1:
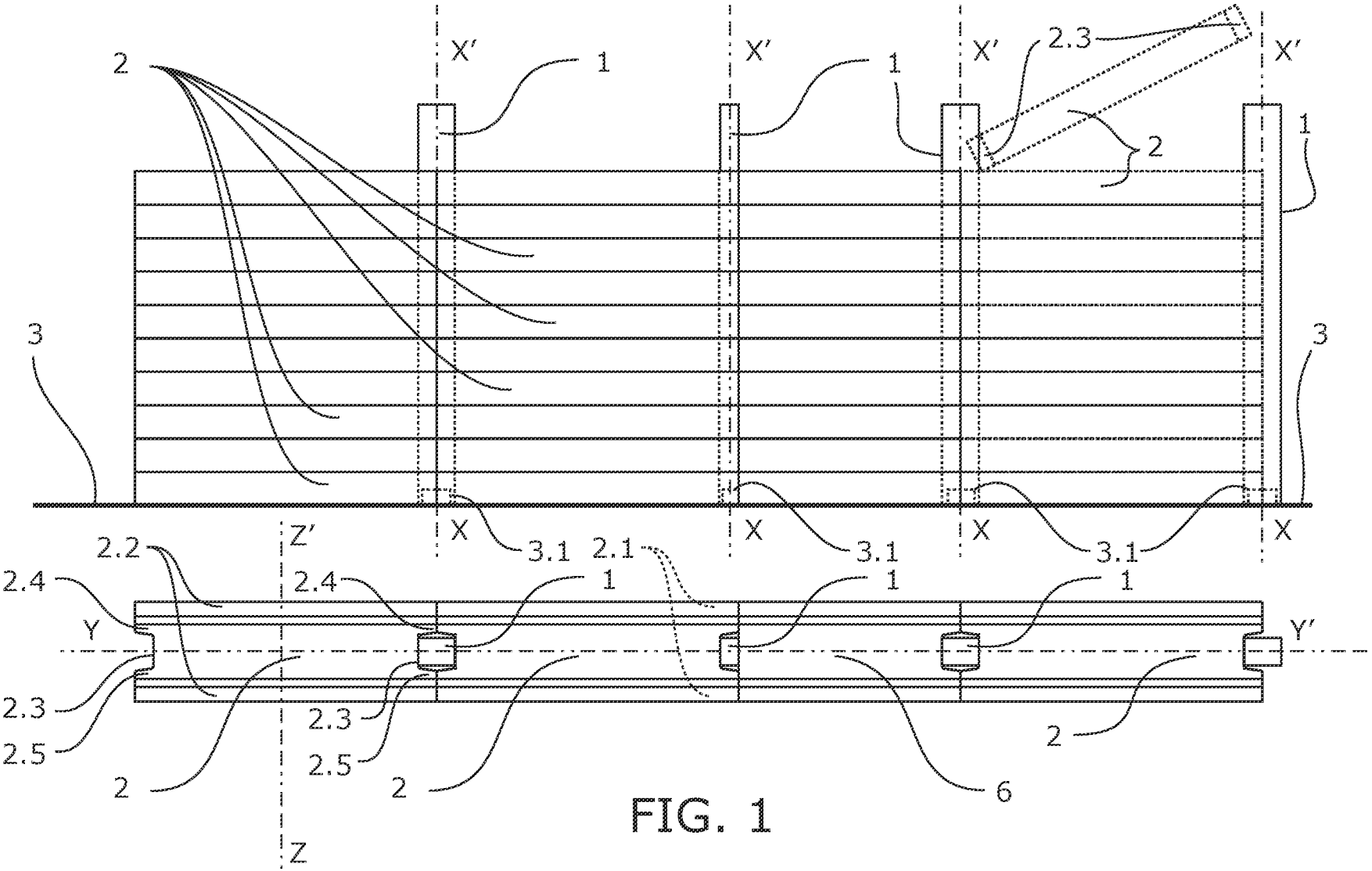
FIG. 1 shows a first embodiment of the invention with various options, this example being shown in a front view in the upper part of the figure and in a plan view in the lower part of the figure.

FIG. 1 shows an embodiment of a constructive assembly formed by the combination of rigid guide profiles (1) and a plurality of blocks (2) which are fixed after construction to the guide profiles (1). This embodiment shows several specific solutions combined with one another to show the scope of the invention; nevertheless, each of the specific solutions can be applied independently.

FIG. 1 shows the front view of the constructive assembly in the upper part and the plan view of the same constructive assembly in the lower part.

Specifically, the constructive assembly starts from a lower base (3) which, in this embodiment, is configured from a metal plate, on which there have been distributed along a straight line fixing elements (3.1) configured for fixing the lower end of each of the guide profiles (1). In this specific case, the fixing elements (3.1) are parts which are housed inside the guide profile (1).

Therefore, the lower base (3) together with the fixing elements (3.1) can be factory-made, determining the exact distance between guide profiles (1) to prevent the need to measure the exact position of each guide profile (1) on site.

Once the base (3) is positioned on site, the guide profiles (1) are attached to each fixing element (3.1), for example by welding or simply by inserting the profiles in housings provided for this purpose, these profiles being parallel and vertical according to the direction of gravity. In this embodiment, vertical direction is the first longitudinal direction X-X'.

Following the order of construction, the next step is that of situating the blocks (2) so that each of them is fixed between two guide profiles (1).

Figure 2:
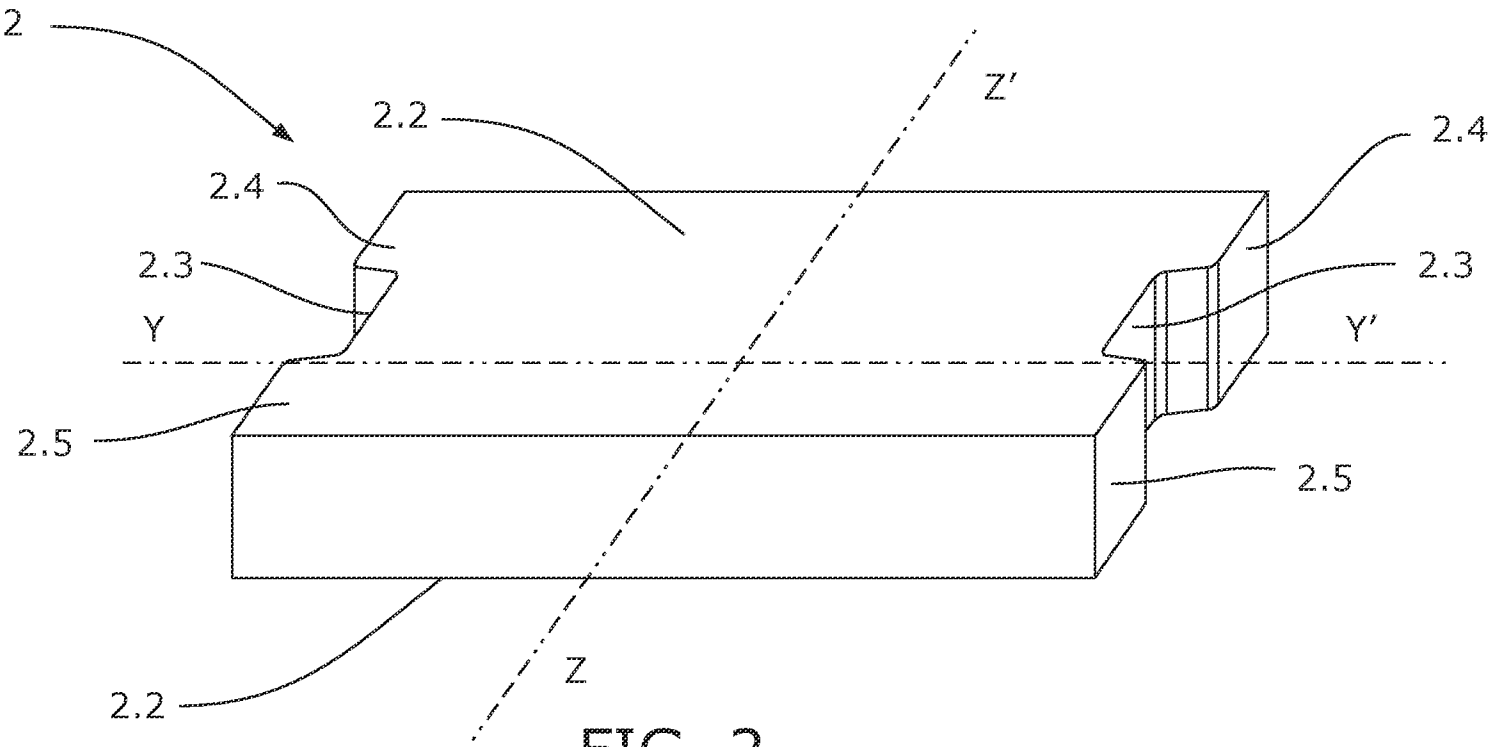
FIG. 2 shows an embodiment of a block.

The configuration of a block (2) can be observed in the front view, and particularly in the plan view of the lower part of FIG. 1. FIG. 2 shows another embodiment that is simpler than the block used in FIG. 1.

The block (2) shown in FIG. 2 is a block (2) having an essentially planar configuration limited by a first supporting base (2.1) located in the lower part and a second supporting base (2.2) located in the upper part and parallel to the first supporting base (2.1). In this embodiment, both supporting bases are configured as a planar surface and extend along the entire upper and lower areas of the block (2).

The block (2) is elongated defining a second longitudinal direction Y-Y' such that the block has a first end and a second end opposite the first end according to the second longitudinal direction Y-Y'. At each of the ends, the block (2) shows a cavity (2.3) located between two fixing flanges (2.4, 2.5).

The cavity (2.3) is configured for housing part of the guide profile (1) when it is in its final position. The plan view of the lower part of FIG. 1 allows observing four guide profiles (1).

Three guide profiles (1) have a size such that they allow the fixing of two blocks (2), i.e., the two blocks (2) that are located on either side, given that the fixing flanges (2.4, 2.5) of each block (2) surround or hold only half of the guide profile (1), with the fixing flanges (2.4, 2.5) of the other profile being those which surround or hold only the other half of the guide profile (1).

This figure shows another guide profile (1) with half the width of the other guide profiles (1) as it is housed in the cavity (2.3) of a block (2) but adjacent to a finishing block (6) lacking the cavity (2.3). These finishing blocks (6) will be described in more detail using other drawings below.

It is observed in the same figure that unlike the blocks shown in FIG. 2, the blocks (2) used in this embodiment have a first supporting base (2.1) and a second supporting base (2.2) limited to two planar side bands located at the side ends of the block (2).

This same FIG. 1 shows a third direction, the transverse direction Z-Z' with respect to the second longitudinal direction Y-Y'. Therefore, the two planar side bands of the first supporting base (2.1) and the second supporting base (2.2) are located at end positions according to the transverse direction Z-Z'.

The central region of the block according to the transverse direction Z-Z' both in the first supporting base (2.1) and in the second supporting base (2.2) is sunken, that is, the block (2) has a smaller thickness in its central portion according to the transverse direction Z-Z', showing respective transition bands between the central portion and the end bands in which the supporting bases (2.1, 2.2) are located. As a result, the transition bands are shown as two lines that are parallel to each side of the second longitudinal direction Y-Y'.

This same FIG. 1 also shows in the right upper part the way of situating a block (2). Once located between two guide profiles (1), removal of the block (2) is prevented according to the transverse direction Z-Z' given that the fixing flanges (2.4, 2.5) located on both sides of the cavity (2.3) prevent the removal thereof by abutting against the guide profile (1).

To introduce the block (2), it is first tilted such that the projection according to direction X-X' has a reduced length and allows placement until it is located between two guide profiles (1). By turning the block (2) again so that its second longitudinal direction Y-Y' is perpendicular to the first longitudinal direction X-X' defined by the guide profiles (1), respective guide profiles (1) are housed in either cavity (2.3) of the block (2), respectively.

This way of situating the blocks (2) gives rise to a stack in which each block (2) prevents the removal of the block (2) or blocks (2) already situated in place.

When the wall is vertical, the action of gravity stabilizes the construction and the blocks do not require additional fixing elements.

Figure 3:
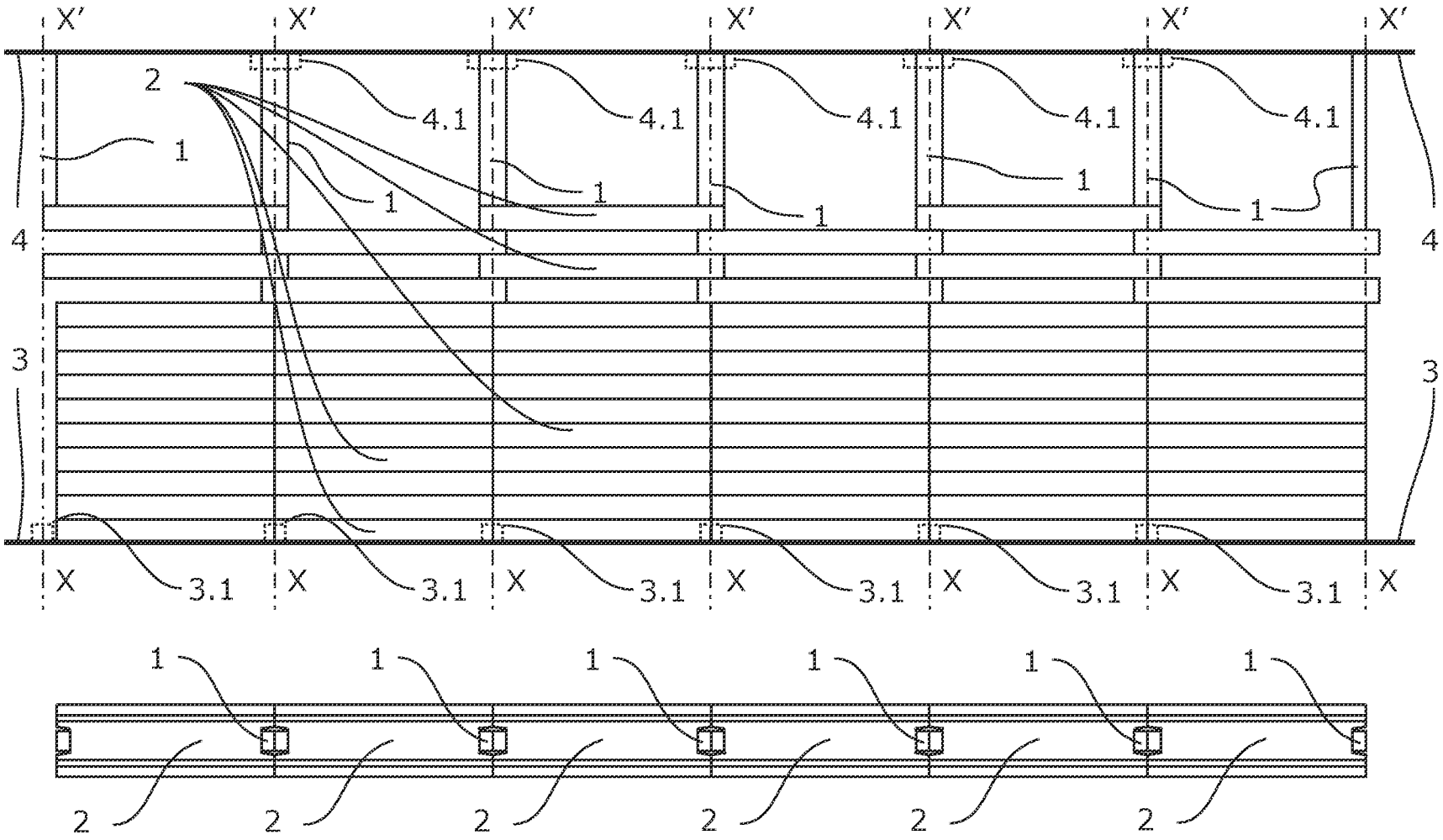
FIG. 3 shows in the upper part an front view of a portion of a wall according to an embodiment of the invention, in which a wall area without gaps and a wall area with gaps are combined, the latter being in the upper part. The plan view of the same example according to the first area without gaps is shown in the lower part of the figure.

FIG. 3 shows another embodiment in which the wall is also vertical. Nevertheless, in addition to the lower base (3) with its fixing elements (3.1), there is an upper base (4) which also has fixing elements (4.1) which allow joining the opposite end of each guide profile (1), assuring the parallelism of the guide profiles (1) and the stability of the construction to a greater extent.

FIG. 3 shows in the lower part the plan view of the first blocks (2), wherein each guide profile (1) establishes the fixing of the blocks (2) located on either side such that it is housed partially in the cavities (2.3) of the two blocks (2) and the fixing flanges (2.4, 2.5) encompass half the guide profile (1). With this configuration, the fixing flanges (2.4, 2.5) of one block (2) do not overlap with the fixing flanges (2.4, 2.5) of the block (2) located on the other side of the guide profile (1).

Above these blocks (2), a different configuration shown only in the front view has been used.

The blocks (2) used after a certain height have fixing flanges (2.4, 2.5) of greater length such that the fixing flanges (2.4, 2.5) of one block (2) overlap with the fixing flanges (2.4, 2.5) of the block (2) located on the other side of the same guide profile (1). As a result, the support between consecutively stacked blocks (2) is mainly established in the overlapping between fixing flanges (2.4, 2.5), and ventilation gaps are established between blocks (2) stacked between two guide profiles (1).

FIGS. 4A to 4E show different configurations of blocks (2) and finishing blocks (6). In particular, the blocks shown in FIGS. 4A, 4B, and 4D are blocks (2) comprising at each end a cavity (2.3) located between fixing flanges (2.4, 2.5). In FIG. 4B, the fixing flanges (2.4, 2.5) have a dimension according to the second longitudinal direction Y-Y' equal to half the width of the guide profile (1), giving rise to constructions without overlapping between fixing flanges (2.4, 2.5) of blocks (2) that are joined to the same guide profile (1). FIG. 4A shows a configuration of its fixing flanges (2.4, 2.5) in which those shown on the left, at one end of the block (2), have a dimension smaller than the fixing flanges (2.4, 2.5) located at the opposite end such that in the construction a transition is established between blocks (2) that do not generate gaps as there is no overlapping between fixing flanges (2.4, 2.5) and blocks (2) that do generate gaps as there is overlapping.

In the block (2) shown in FIG. 4D, all the fixing flanges (2.4, 2.5) have larger dimensions to give rise to overlapping.

The block shown in FIG. 4C is a block identified as a finishing block (6). In FIG. 3 in which there is an upper base (4), there is a space limited in the upper portion thereof for introducing a block (2) in an oblique position to then be positioned in its final position, being fixed between two guide profiles (1). For this region and according to an embodiment, finishing blocks (6) in which one or more fixing flanges (2.4, 2.5) have been eliminated such that they allow insertion without having to position the block in an oblique position are used.

In this case, the side of the finishing block (6) which is shown on the left and has two fixing flanges (2.4, 2.5) is the first to be introduced, said finishing block (6) with its two supporting bases (2.1, 2.2) remaining perpendicular to the first longitudinal direction. Therefore, the guide profile (1) of this end is housed in the cavity (2.3) located between the two fixing flanges (2.4, 2.5), where the opposite end of the finishing block (6) may be arranged outside the main plane formed by the plurality of blocks (2). The following movement is that of moving the only fixing flange (2.5) found at the opposite end closer to its guide profile (1) as there is no other fixing flange (2.4) at this same end.

FIG. 4E shows another embodiment in which either end of the finishing block (6) has a single fixing flange (2.4, 2.5) positioned on the side of the visible face of the construction according to the transverse direction Z-Z'. This finishing block (6) allows front insertion according to the transverse direction Z-Z' without turning any of the finishing block (6). The weight or force between consecutive blocks (2, 6) and the friction therebetween establish the required retention of the resulting construction and particularly of these finishing blocks (6).

FIGS. 5A and 5B show a configuration corresponding to what is described in FIGS. 4B and 4D, respectively, only that the first supporting base (2.1) and the second supporting base (2.2) are configured in the form of two side bands leaving the central region extending according to the second longitudinal direction Y-Y' with a smaller thickness. These are the configurations of blocks used in FIGS. 1 and 3 in which the weight of the stack is transmitted between consecutive blocks through these supporting bases (2.1, 2.2) thus configured in two bands.

Figure 6:
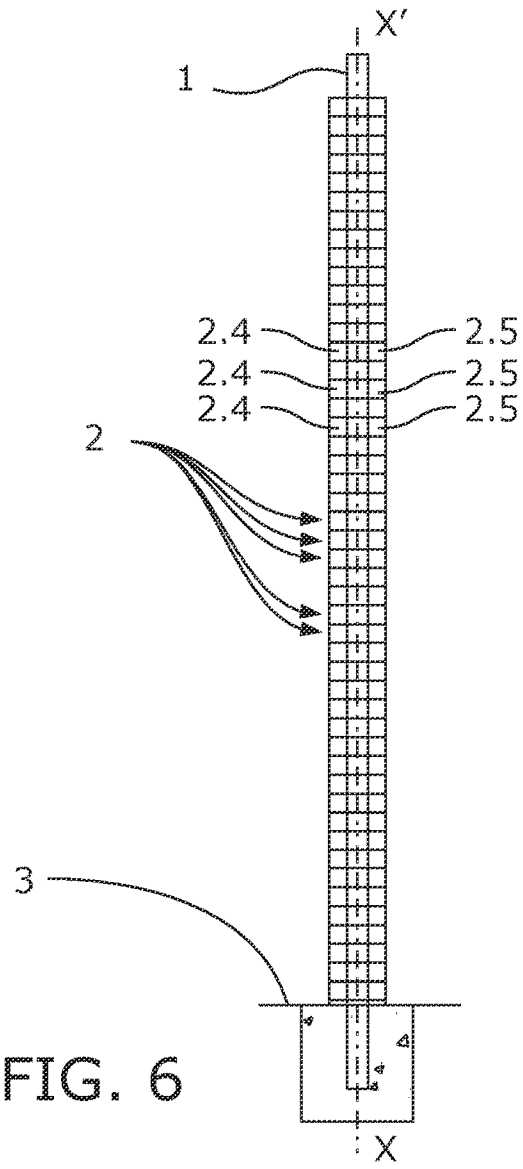

FIG. 6 shows a profile view of an embodiment in which the lower base (3) is a cement foundation constructed directly on the ground, leaving the guide profiles (1) embedded in their final position. Once the lower base (3) has set, the blocks (2) are consecutively stacked giving rise to a free-standing wall.

Figure 7:
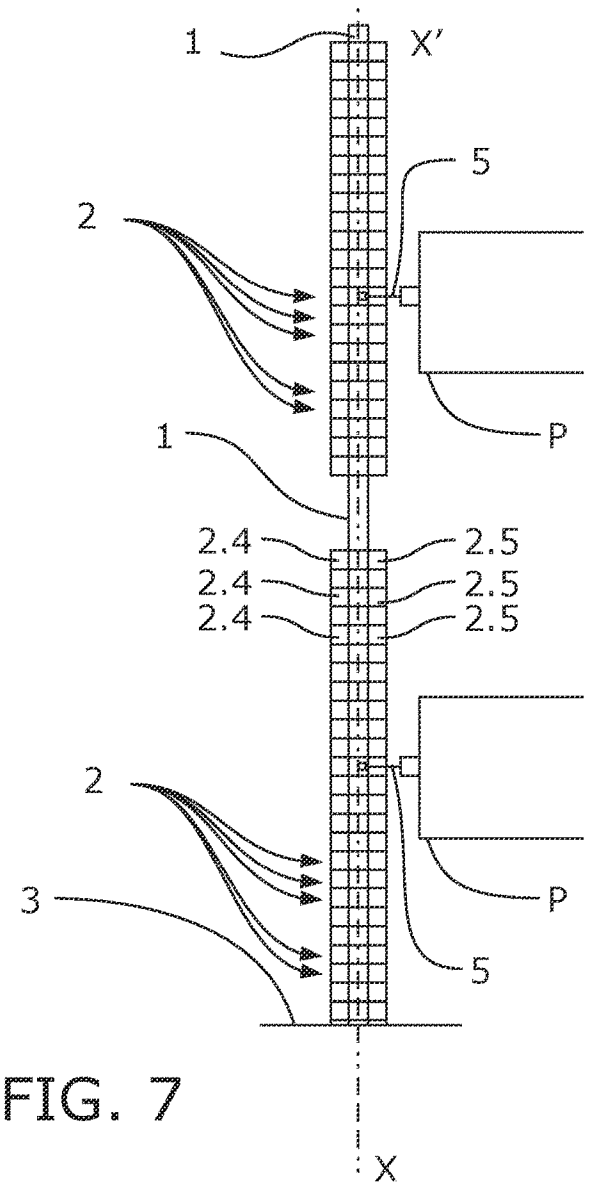
FIGS. 6 and 7 show the profile view of two embodiments, with the wall being free-standing in FIG. 6 and with the wall being fixed to a pre-existing structure or wall in FIG. 7.

FIG. 7 shows a similar construction for the enclosure of a construction, for example a building having several floors. Each of the floors has a precast floor slab ending in a cantilever (P) to which the construction is secured according to an embodiment of the invention. According to another embodiment, the construction is fixed to a wall (P) to be concealed or decorated.

According to this embodiment, a first segment is constructed on the lower base (3) by stacking blocks (2) that are attached to the guide profiles (1) according to any of the described embodiments, for example with or without gaps.

At a certain height, at least one guide profile (1) is attached to the cantilever (P) or wall through an angle plate (5) assuring stability against wind loads, for example. In one embodiment, the angle plate is attached to the guide profile (1) through a plate which is located between the fixing flanges (2.4, 2.5) of the blocks (2) attached to the same guide profile (1). According to another embodiment, the angle plate is attached to the guide profile (1) at a point in which there is located a finishing block (6) without a fixing flange (2.4) leaving access from the inner face of the wall or construction to the guide profile (1) in which the angle plate (5) is fixed. The other end of the angle plate (5) is fixed to the cantilever (P) or wall.

According to another embodiment applicable to any of the described embodiments, at least one guide profile (1) is formed by the attachment of a plurality of longitudinal segments. The aligned attachment of these profile segments can be easily carried out using profiles comprising at least one segment of smaller dimensions and allowing the consecutive insertion of one after another, which furthermore allows assuring the verticality of the resulting guide profile (1).

Figure 8:
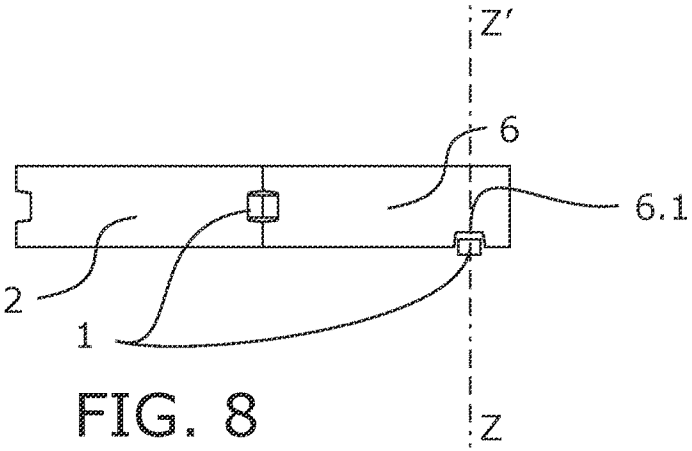
FIG. 8 shows an embodiment for completing the wall in a corner.

FIG. 8 shows an embodiment for terminating a wall constructed using blocks (2) in the intermediate segment thereof and with a finishing block (6) comprising a side slot. In this specific case, the finishing block can be inserted without positioning it in an oblique manner since the placement of the guide profile (1) located at the end of the construction is established by moving the finishing block (6) according to the transverse direction Z-Z'. According to this embodiment, they have a smooth finish both on the face of the constructed wall seen in the top part of the figure and on the right side.

Figure 9:
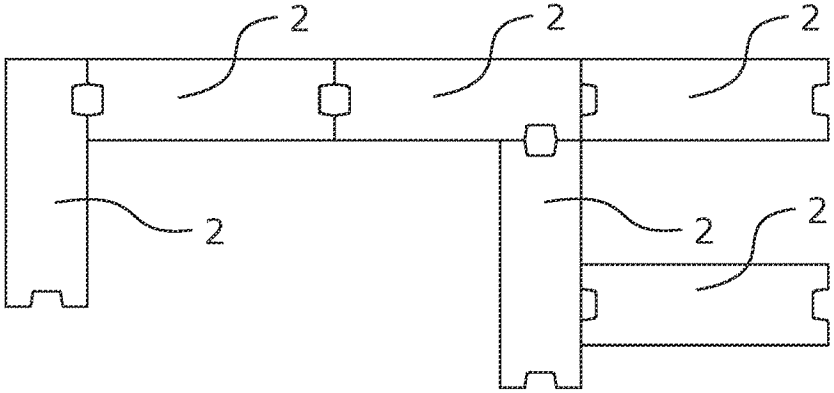
FIG. 9 shows several ways for linking walls formed according to embodiments where the walls converge at a certain point, either at an intermediate point or at an end of another wall.

FIG. 9 shows the versatility of the invention wherein the solutions described for connecting different walls constructed according to the invention and converging at one and the same point can be combined. A corner wall termination using the solution shown in FIG. 8 is used on the left so as to extend, with the same guide profile (1), the wall shown in the top part also terminating in the same manner, with a finishing block (6) which allows extending downwards into another wall.

From the resulting right wall there in turn emerge two walls configured according to examples of the invention, wherein the cavities (2.3) of the free end, in this case the left end considering the orientation of the figure, is concealed as it is in contact with the transverse wall.

Figure 10B:
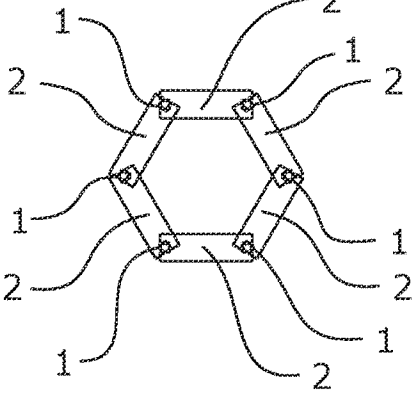
FIGS. 10A and 10B show the plan view of a wall in which the guide profiles are distributed in a fractionated line or open polygon and in a closed polygon, resulting in a column, respectively.
Figure 10A:
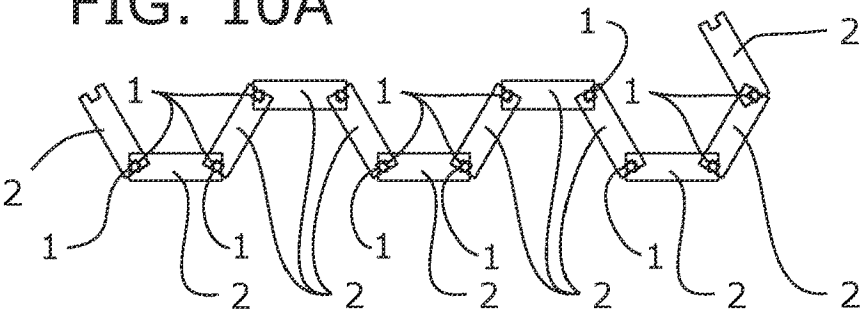

FIG. 10A shows an embodiment in which the guide profiles (1) have a configuration of circular section, allowing the blocks (2) converging in said guide profile (1) to be able to show an angle instead of a straight directrix line. In this embodiment, the resulting construction follows a fractionated directrix and uses blocks (2), wherein the fixing flanges (2.4, 2.5) overlap leaving gaps.

FIG. 10B is a specific example of the example shown in FIG. 10B wherein the fractionated line is closed. The result is a column having a hexagonal section.

Figure 11:
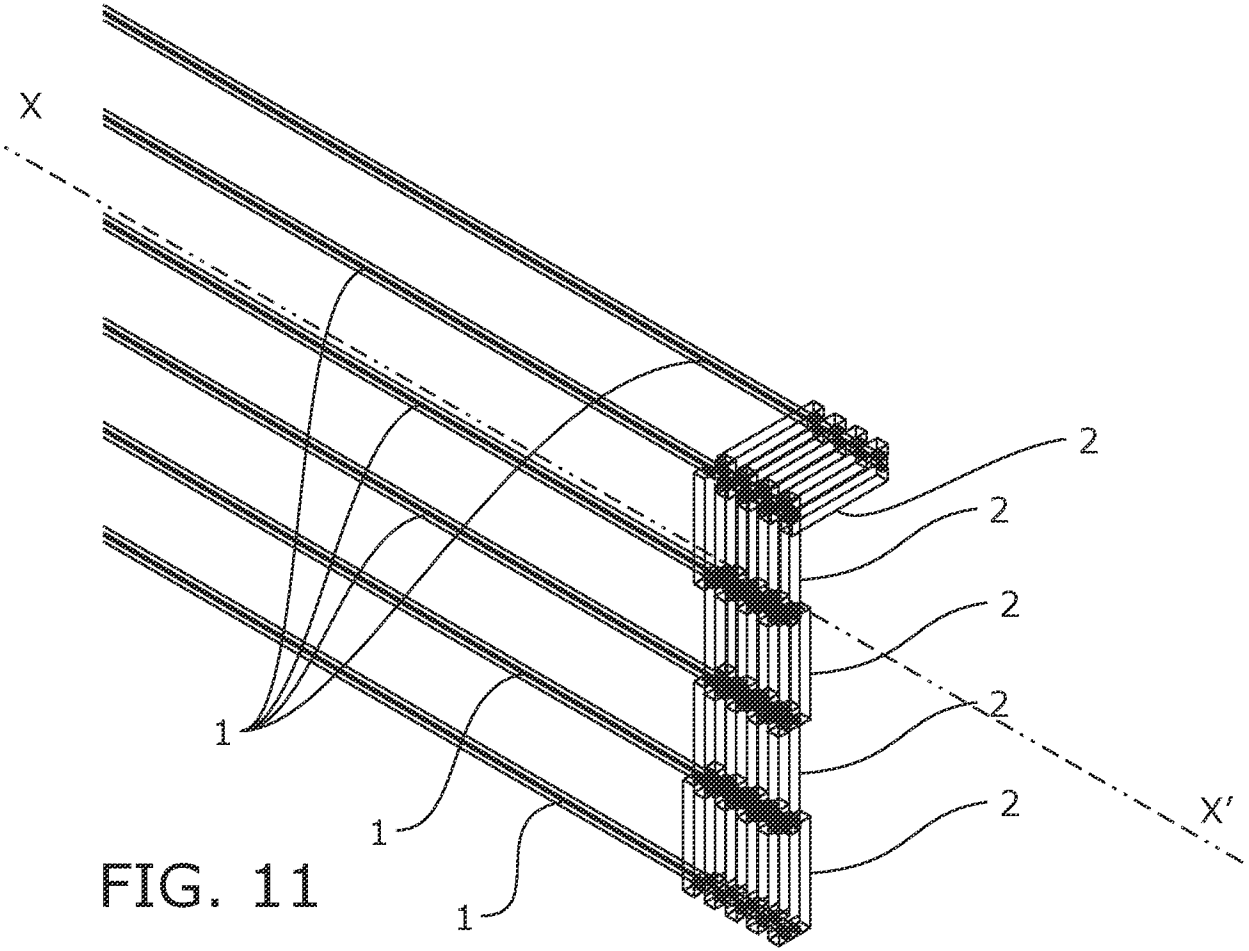
FIG. 11 shows a perspective view in which the blocks are shown as transparent in order to demonstrate the arrangement thereof when the guide profiles are positioned in a parallel and horizontal manner.

FIG. 11 is another embodiment in which the guide profiles (1) are positioned horizontally with respect to gravity. In this embodiment, five guide profiles are contained in a vertical plane and a sixth guide profile (1) is at 90 degrees with respect to the other five guide profiles (1).

In this particular case, the construction is carried out in the same manner wherein the blocks (2) are now in their final position with the first supporting base (2.1) and the second supporting base (2.2) contained in a vertical plane.

Each block (2) is situated by placing it obliquely with respect to the vertical plane to then bring the block (2) to its final position considering the capacity of the guide profiles (1) to allow sliding according to direction X-X' which is horizontal in this case.

In this embodiment, the weight of each block (2) rests on one of the guide profiles (1) or the two guide profiles (1) to which it is connected by means of the cavity (2.3) housing same. That is, in this embodiment the stack is horizontal and the weight of each block (2) does not contribute to the contacting blocks being retained by friction.

According to this configuration, the bases previously identified as lower base (3) and upper base (4) are now arranged parallel to vertical planes and limit on either side blocks (2) located in their final position. This same vertical plane intersects with the guide profiles (1) giving rise to a fractionated line. In this embodiment, the fractionated line is formed by four aligned segments and with a fraction at 90° degrees in the upper part thereof.

The invention claimed is:

1. A constructive assembly, comprising:

a plurality of guide profiles, each guide profile comprised of a rigid rod extending along a first longitudinal direction;

a plurality of blocks, wherein each of:

the blocks have an elongated configuration extending along a second longitudinal direction, the blocks comprise a first supporting base and a second supporting base parallel to the first supporting base, wherein both supporting bases are in turn parallel to the second longitudinal direction, the blocks comprise at each end according to the second longitudinal direction a cavity located between two fixing flanges, wherein each cavity receives a respective said guide profile of the plurality of guide profiles such that said respective guide profile limits movement thereof according to a direction transverse to the second longitudinal direction and parallel to any of the supporting bases;

wherein the plurality of guide profiles are fixed and distributed such that the guide profiles are parallel to and uniformly spaced from one another;

the plurality of blocks are distributed such that the blocks are stacked between two of the guide profiles of the plurality of guide profiles, wherein for each respective block of the plurality of blocks the respective guide profile of the plurality of guide profiles is housed at least partially in the cavity of one end of the respective block and another guide profile of the plurality of guide profiles is housed at least partially in the cavity of opposite end of the respective block, and each respective block is secured to the two guide profiles maintaining a sliding attachment according to a respective said longitudinal direction of the respective guide profile;

wherein the blocks located on either side of one and same guide profile have overlapping fixing flanges, giving rise to gaps in the constructive assembly wherein blocks comprising overlapping fixing flanges are configured such that:

the blocks located on either side of one and the same guide profile comprise said fixing flanges that have a size such that each fixing flange of a respective said block at one side of the same guide profile reaches a respective said fixing flange of a respective said block of an adjacent stack, that is, the respective block located at the other side of the same guide profile and, lower base of the respective block does not rest on the respective block located immediately therebelow but rather on the fixing flanges of the respective blocks of the adjacent stacks.

2. The constructive assembly according to claim 1, comprising said blocks for finishing an end of the stack wherein the cavity is only limited on one side by a respective said fixing flange to allow insertion according to the transverse direction.

3. The constructive assembly according to claim 1, wherein the respective guide profile has a circular section.

4. The constructive assembly according to claim 1, wherein the guide profiles are oriented vertically where the stack of blocks rests on the lower base.

5. The constructive assembly according to claim 1, wherein the guide profiles are oriented horizontally.

6. The constructive assembly according to claim 1, wherein the blocks located on either side of one and the same guide profile which do not have any overlapping, such that said respective guide profile is housed partially in one of the cavities of the block or blocks located on one side of the respective guide profile, and the same guide profile is housed partially in one of the cavities thereof.

7. The constructive assembly according to claim 1, wherein the guide profiles are attached at one end to an upper base.

8. The constructive assembly according to claim 1, wherein the guide profiles are attached at one end to a lower base.

9. The constructive assembly according to claim 8, wherein the attachment in the lower base is by means of a plate configured with fixing elements positioned to define correct distance between the guide profiles.

10. The constructive assembly according to claim 1, wherein the guide profiles comprise one or more fixing means for attachment of the constructive assembly to a wall or a pre-existing structure.

11. The constructive assembly according to claim 5, wherein the fixing means are one or more angle plates.

12. The constructive assembly according to claim 1, wherein the blocks attached to a respective guide profile form a corner.

13. The assembly according to claim 12, wherein the corner is 90° and the blocks attached to the respective guide profile are finishing blocks having a respective said cavity for at least partially housing the respective guide profile on a side according to the second longitudinal direction.

14. The assembly according to claim 1, wherein at least one said guide profile is configured by attachment of two or more longitudinal profiles arranged consecutively according to the first longitudinal direction.

15. The assembly according to claim 14, wherein at least one said longitudinal profile has at one end a segment of smaller dimensions, configured for being housed at an end of a longitudinal segment to which attached.

16. A method of mounting the constructive assembly according to claim 1, the method comprising the following steps:

a) positioning at least two said guide profiles, distributed such that the at least two guide profiles are parallel according to the respective longitudinal direction, and spaced from one another, b) placing a respective said block in an oblique position in respect to a direction perpendicular to the respective longitudinal direction and being said respective block between the at least two guide profiles, c) turning the respective block such that the two cavities of the respective block receive a corresponding said guide profile of the at least two guide profiles, d) repeating steps b) and c) with additional said blocks and placing the additional blocks in a stacked manner.

17. The method according to claim 16, wherein step c) further comprises fixing the respective block to the two guide profiles.

18. The method according to claim 16, wherein steps b) to d) are repeated to obtain a wall.

* * * * *